US008208829B2

(12) United States Patent
Goda et al.

(10) Patent No.: US 8,208,829 B2
(45) Date of Patent: Jun. 26, 2012

(54) IMAGE FORMING APPARATUS AND IMAGE FORMING UNIT

(75) Inventors: Mitsuhiro Goda, Osaka (JP); Yasuyuki Fukunaga, Osaka (JP)

(73) Assignee: Kyocera Mita Corporation (JP)

( * ) Notice: Subject to any disclaimer, the term of this patent is extended or adjusted under 35 U.S.C. 154(b) by 421 days.

(21) Appl. No.: 12/548,474

(22) Filed: Aug. 27, 2009

(65) Prior Publication Data

US 2010/0054795 A1 Mar. 4, 2010

(30) Foreign Application Priority Data

Aug. 27, 2008 (JP) ..... 2008-218229

(51) Int. Cl.
*G03G 15/08* (2006.01)

(52) U.S. Cl. ..... 399/102; 399/346

(58) Field of Classification Search ..... 399/102, 399/103, 157, 159, 274, 279, 286, 346
See application file for complete search history.

(56) References Cited

U.S. PATENT DOCUMENTS 5,610,690 A * 3/1997 Yoshihara et al. ..... 399/167
2006/0285897 A1* 12/2006 Sugiura et al. ..... 399/346
2008/0025752 A1* 1/2008 Suyama et al. ..... 399/98

FOREIGN PATENT DOCUMENTS

| | | |
|---|---|---|
| JP | 2004-233612 | 8/2004 |
| JP | 2006-251751 | 9/2006 |
| JP | 2006-259274 | 9/2006 |
| JP | 2007-139808 | 6/2007 |

* cited by examiner

*Primary Examiner* — David Gray
*Assistant Examiner* — Barnabas Fekete
(74) *Attorney, Agent, or Firm* — Gerald E. Hespos; Michael J. Porco

(57) ABSTRACT

An image forming apparatus is provided with an image bearing member for bearing a toner image while rotating, a developing device including a developing roller for supplying toner to a surface of the image bearing member and a pair of gap rollers held in contact with opposite end portions of the image bearing member to define a specified gap between the developing roller and the surface of the image bearing member, and a lubricant applicator for applying a lubricant to parts of the opposite end portions of the image bearing member where the gap rollers are in contact.

9 Claims, 6 Drawing Sheets

IMAGE FORMING APPARATUS AND IMAGE FORMING UNIT

BACKGROUND OF THE INVENTION

1. Field of the Invention

The present invention relates to an image forming apparatus provided with an image bearing member on the outer surface of which a toner image is to be formed, and an image forming unit employed in this image forming apparatus.

2. Description of the Related Art

There has been known an image forming apparatus constructed such that an electrostatic latent image is formed on the circumferential surface of a photoconductive drum (image bearing member) by reading a document image or based on image information transmitted from an external computer or the like, toner is supplied toward this electrostatic latent image from a developing device to form a toner image on the circumferential surface, and this toner image is transferred to a sheet.

In such an image forming apparatus, a proper image forming process is hindered in some cases due to residual toner remaining on the circumferential surface of the photoconductive drum after an image transferring process to a sheet and/or the deposition of nitrogen oxides produced during a high voltage charging process performed before an electrostatic latent image is formed on the circumferential surface.

In order to solve such problems, Japanese Unexamined Patent Publication No. 2006-259274 discloses an image forming apparatus provided with a coating bar made of a solid lubricant such as zinc stearate, wherein the lubricant from this coating bar is supplied to the circumferential surface of a photoconductive drum. In this apparatus, a fur brush driven to rotate is interposed between the coating bar and the photoconductive drum and the lubricant from the coating bar is applied to the circumferential surface of the image bearing member via this fur brush. Since frictional resistance of the circumferential surface of the photoconductive drum is reduced to make this circumferential surface lubricant by the application of the lubricant to the circumferential surface of the photoconductive drum, the deposition of foreign matters such as residual toner and nitrogen oxides is suppressed and an image failure caused by these extraneous matters is effectively prevented.

However, in the conventional image forming apparatus, the lubricant is mainly applied to an image formation region on the circumferential surface of the photoconductive drum. Thus, the deposition of foreign matters is prevented from this image formation region, but no consideration is made for the opposite end portions of the photoconductive drum not belonging to the image formation region.

In order to define tiny clearances (gaps) between the circumferential surface of a developing roller of a developing device and that of the photoconductive drum, gap rollers are in contact with the opposite end portions of the photoconductive drum in some cases. Thus, if extraneous matters are accumulated on the surfaces of the opposite end portions of the photoconductive drum, the gap rollers run onto and run off from these extraneous matters according to the rotation of the photoconductive drum, thereby varying a gap size. This makes toner supply to the circumferential surface of the photoconductive drum from the developing roller unstable, thereby presenting a problem of being unable to form a stable toner image on the circumferential surface of the photoconductive drum.

SUMMARY OF THE INVENTION

An object of the present invention is to constantly form a toner image on the circumferential surface of an image bearing member in a stable state.

One aspect of the present invention is directed to an image forming apparatus, including an image bearing member for bearing a toner image while rotating; a developing device including a developing roller for supplying toner to a surface of the image bearing member and a pair of gap rollers held in contact with opposite end portions of the image bearing member to define a specified gap between the developing roller and the surface of the image bearing member; and a lubricant applicator for applying a lubricant to parts of the opposite end portions of the image bearing member where the gap rollers are in contact.

These and other objects, features and advantages of the present invention will become more apparent upon a reading of the following detailed description with reference to accompanying drawings.

BRIEF DESCRIPTION OF THE DRAWINGS

FIG. 5 is a section along V-V of FIG. 4, and FIGS. 6A and 6B are perspective views, partly cut away, showing one embodiment of a side sealing member, wherein

DETAILED DESCRIPTION OF THE PREFERRED EMBODIMENTS

Figure 1:
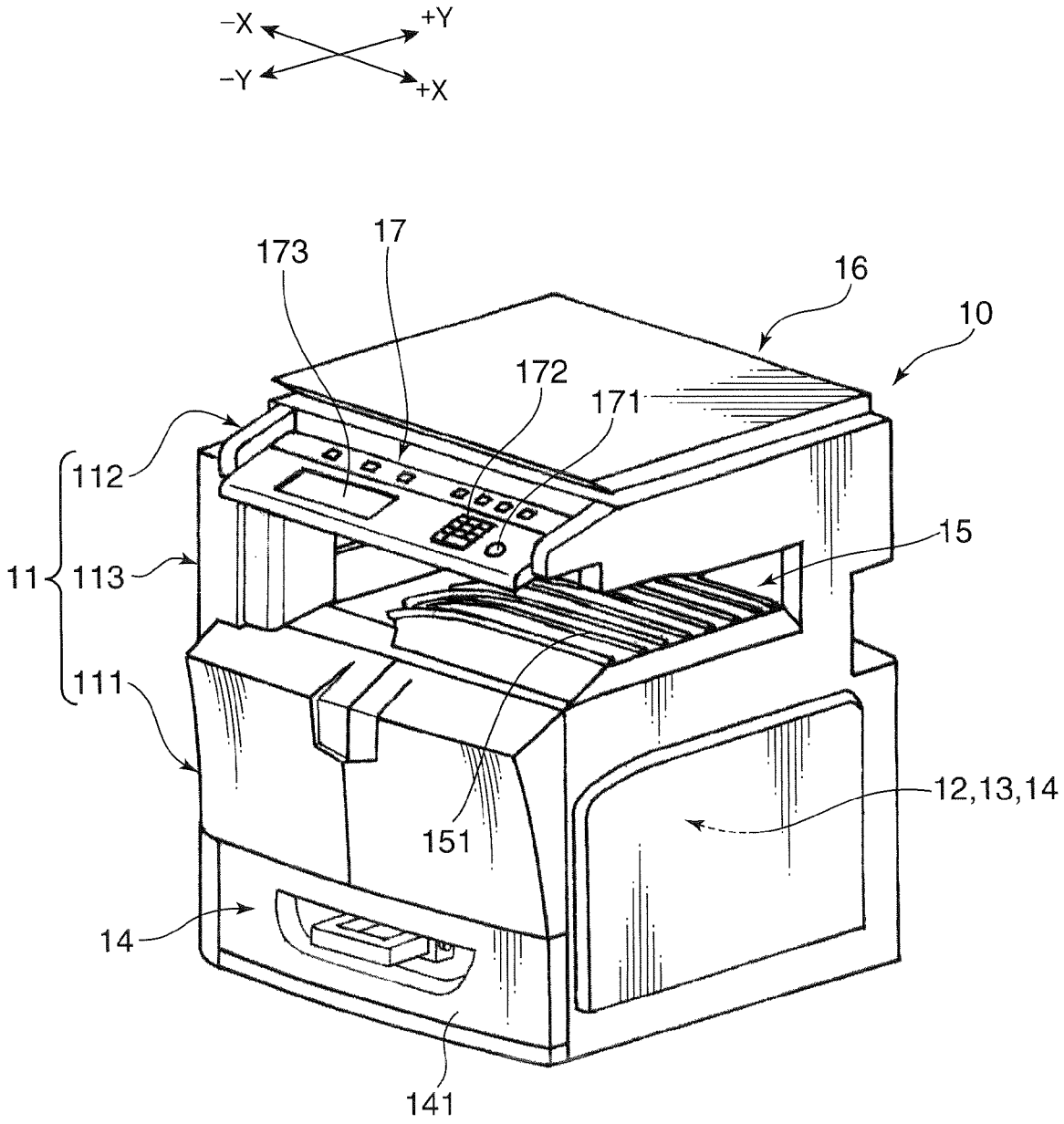
FIG. 1 is a perspective view showing one embodiment of an image forming apparatus according to the invention.
Figure 2:
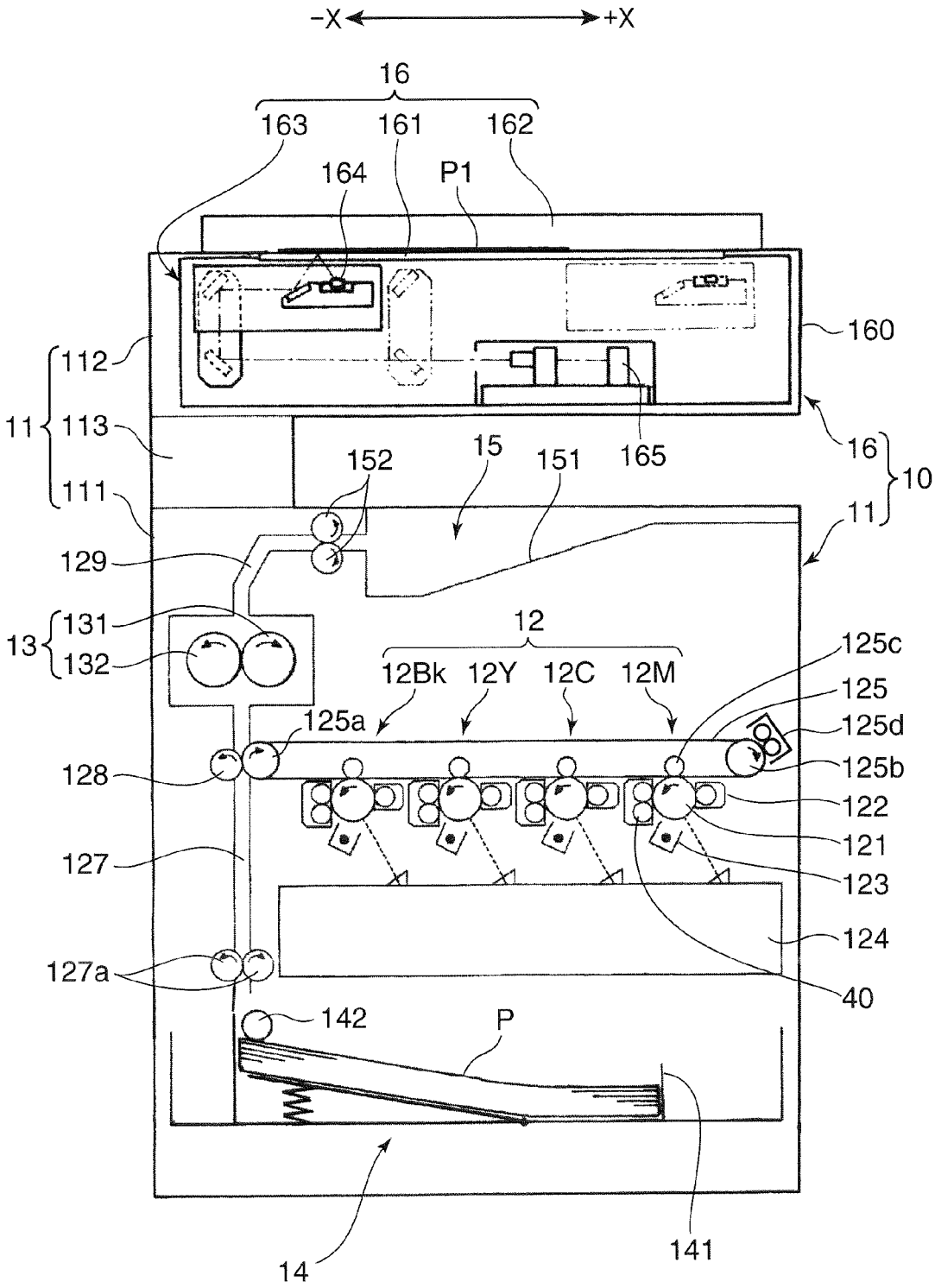
FIG. 2 is a front view in section showing an internal construction of the image forming apparatus of FIG. 1.

FIG. 1 is a perspective view showing one embodiment of an image forming apparatus 10 according to the present invention, and FIG. 2 is a front view in section showing an internal construction of the image forming apparatus 10. In FIGS. 1 and 2, X-X directions indicate leftward and rightward directions, wherein −X direction indicates leftward direction and +X direction indicates rightward direction, and Y-Y directions indicate forward and backward directions, wherein −Y direction indicates forward direction and +Y direction indicates backward direction.

The image forming apparatus 10 is a copier of the so-called internal discharge type and is provided with an apparatus body 11, an image forming station 12, a fixing unit 13, a sheet storing unit 14, a discharge unit 15, an image reading unit 16 and an operation unit 17 which are all installed in the apparatus body 11. The discharge unit 15 is formed by partly indenting the apparatus body 11 below the image reading unit 16.

The apparatus body 11 includes a lower body 111 having a rectangular parallelepipedic outer shape, an upper body 112 having a flat rectangular parallelepipedic outer shape and facing the lower body 111 from above, and a connecting body 113 interposed between the upper and lower bodies 112, 111. The connecting body 113 is a structure for connecting the lower and upper bodies 111, 112 with each other with the discharge unit 15 formed between the lower and upper bodies 111, 112, and stands from a left part of the lower body 111. The upper body 112 has a left part thereof supported on the upper end of the connecting body 113.

The image forming station 12, the fixing unit 13 and the sheet storing unit 14 are installed in the lower body 111, and the image reading unit 16 is installed in the upper body 112. The operation unit 17 project forward from a front edge portion of the upper body 112.

The discharge unit 15 is formed between the lower and upper bodies 111, 112 and includes an internal discharge tray 151 formed on the upper surface of the lower body 111. A sheet P having a toner image transferred thereto in the image forming station 12 is discharged from a lower part of the connecting body 113 toward this internal discharge tray 151.

The image forming station 12 is described below with reference to FIG. 2. The image forming station 12 is for forming a toner image on a sheet P fed from the sheet storing unit 14 and includes a magenta image forming part 12M, a cyan image forming part 12C, a yellow image forming part 12Y and a black image forming part 12Bk successively arranged from an upstream side (right side) toward a downstream side as shown in FIG. 2.

Each of the image forming parts 12M, 12C, 12Y and 12Bk includes a photoconductive drum (image bearing member) 121 and a developing device 122. Toner is supplied to each photoconductive drum 121 from a corresponding developing device 122 while the photoconductive drum 121 is rotated in a counterclockwise direction in FIG. 2. Each developing device 122 is replenished with toner from an unillustrated corresponding toner cartridge arranged at a front side of the apparatus body 111 (front side with respect to the plane of FIG. 2).

Chargers 123 are disposed at positions right below the respective photoconductive drum 121, and exposure devices 124 are disposed at positions further below the respective chargers 123. The circumferential surfaces of the respective photoconductive drums 121 are uniformly charged by the chargers 123. The respective exposure devices 124 irradiate laser beams corresponding to the respective colors based on image data read by the image reading unit 16 to the charged circumferential surfaces of the photoconductive drums 121, thereby forming electrostatic latent images on the circumferential surfaces of the photoconductive drums 121. Toners are supplied from the developing devices 122 to such electrostatic latent images, whereby toner images are formed on the circumferential surfaces of the photoconductive drums 121.

A transfer belt 125 is so arranged at a position above the photoconductive drums 121 as to be held in contact with the respective photoconductive drums 121. This transfer belt 125 is mounted between a drive roller 125*a* disposed at a left position of FIG. 2 and a driven roller 125*b* disposed at a right position of FIG. 2. Such a transfer belt 125 is rotated between the drive roller 125*a* and the driven roller 125*b* in synchronism with the respective photoconductive drums 121 while being pressed against the circumferential surfaces of the photoconductive drums 121 by transfer rollers 125*c* disposed in correspondence with the respective photoconductive drums 121.

Accordingly, as the transfer belt 125 is rotated, a magenta toner image is transferred to the outer surface of the transfer belt 125 by the photoconductive drum 121 of the magenta image forming part 12M and, successively, a cyan toner image is transferred to the same position of the transfer belt 125 in a superimposition manner by the photoconductive drum 121 of the cyan image forming part 12C. Thereafter, a yellow toner image and a black toner image are similarly successively transferred in a superimposition manner by the yellow image forming part 12Y and the black image forming part 12Bk. In this way, a color image is formed on the outer surface of the transfer belt 125. The color image formed on the outer surface of the transfer belt 125 is transferred to a sheet P conveyed from the sheet storing unit 14.

A drum cleaner 40 for cleaning the circumferential surface of the photoconductive drum 121 by removing residual toner is disposed at a position to the left of each photoconductive drum 121 in FIG. 2. The circumferential surface of the photoconductive drum 121 cleaned by the drum cleaner 40 heads for the charger 123 for a new charging process. Waste toner removed from the circumferential surface of the photoconductive drum 121 by the drum cleaner 40 is collected into an unillustrated toner collection bottle via a specified path.

A vertically extending sheet conveyance path 127 is provided at a position to the left of the image forming station 12. A pair of conveyor rollers 127*a* are disposed at a specified position of this sheet conveyance path 127, and a sheet P from the sheet storing unit 14 is conveyed toward the transfer belt 125 mounted on the drive roller 125*a* by driving this pair of conveyor rollers 127*a*.

A second transfer roller 128 held in contact with the outer surface of the transfer belt 125 is disposed at a position of the sheet conveyance path 127 facing the drive roller 125*a*. The sheet P is pressed between the transfer belt 125 and the second transfer roller 128 while being conveyed along the sheet conveyance path 127, whereby the toner image on the transfer belt 125 is transferred to the sheet P.

A belt cleaner 125*d* for removing residual toner remaining on the outer surface of the transfer belt 125 is disposed to the right of the transfer belt 125. The transfer belt 125 having finished with the transferring process to the sheet P is rotated for a next transferring process after being cleaned by having the residual toner on the outer surface removed by this belt cleaner 125*d*.

The fixing unit 13 is for fixing the toner image transferred in the image forming station 12 to the sheet P and includes a fixing roller 131 internally fitted with an electrical heating element such as a halogen lamp as a heat source inside, and a pressure roller 132 arranged to face the fixing roller 131 from the left side. The sheet P finished with the transferring process and introduced from the image forming station 12 via the second transfer roller 128 is subjected to a fixing process of fixing the toner image thereto by a heating process by the fixing roller 131 while being pressed between the fixing roller 131 and the pressure roller 132.

The color printed sheet P finished with the fixing process passes along a discharge conveyance path 129 extending upward from the fixing unit 13 to be discharged toward the internal discharge tray 151 via a pair of discharge rollers 152.

The sheet storing unit 14 includes a sheet tray 141 detachably mounted at a position below the exposure devices 124 in the apparatus body 11. A bundle of sheets is stored in the sheet tray 141, and the sheets P are dispensed one by one from this bundle of sheets by driving a pickup roller 142 and introduced to the image forming station 12 via the sheet conveyance path 127.

The image reading unit 16 includes a contact glass 161 which is mounted in an opening formed in the upper surface of the upper body 112 and on which a document P1 is placed with a document surface faced down, a document pressing mat 162 openable and closable with respect to the contact glass 161 to press the document placed on the contact glass 161 and an optical unit 163 installed in the upper body 112 to read a document image of the document P1 placed on the contact glass 161.

The optical unit 163 irradiates light from a light source 164 toward the document image from below via the contact glass 161 with the document placed on the contact glass 161 pressed by the document pressing member 162. Reflected light from the document surface is introduced to a CCD (charge coupled device) 165. The CCD 165 generates an analog image signal by photoelectrically converting the reflected light. This analog image signal is outputted to the exposure devices 124 of the image forming station 12 after being digitized.

The operation unit 17 is operated to enter various items (sheet size, number of sets to be processed, etc.) concerning the image forming process. As shown in FIG. 1, a start key 171, a numeric keypad 172 used to enter numerical information, an LCD (liquid crystal display) 173 for displaying input information actually entered using the numeric keypad 172, error messages, etc. and the like are provided in the operation unit 17.

In this embodiment, the photoconductive drum 121, the charger 123, the drum cleaner 40, a lubricant applicator 50 to be described and the like are unitized into a drum unit (image forming unit) 20 in the image forming apparatus 10 constructed as above. The drum unit 20 is provided in each of the image forming parts 12M, 12C, 12Y and 12Bk. These respective four drum units 20 are structurally identical while differing only in the type of toner to be used. Such drum units 20 are described below with reference to FIGS. 3 to 5.

Figure 3:
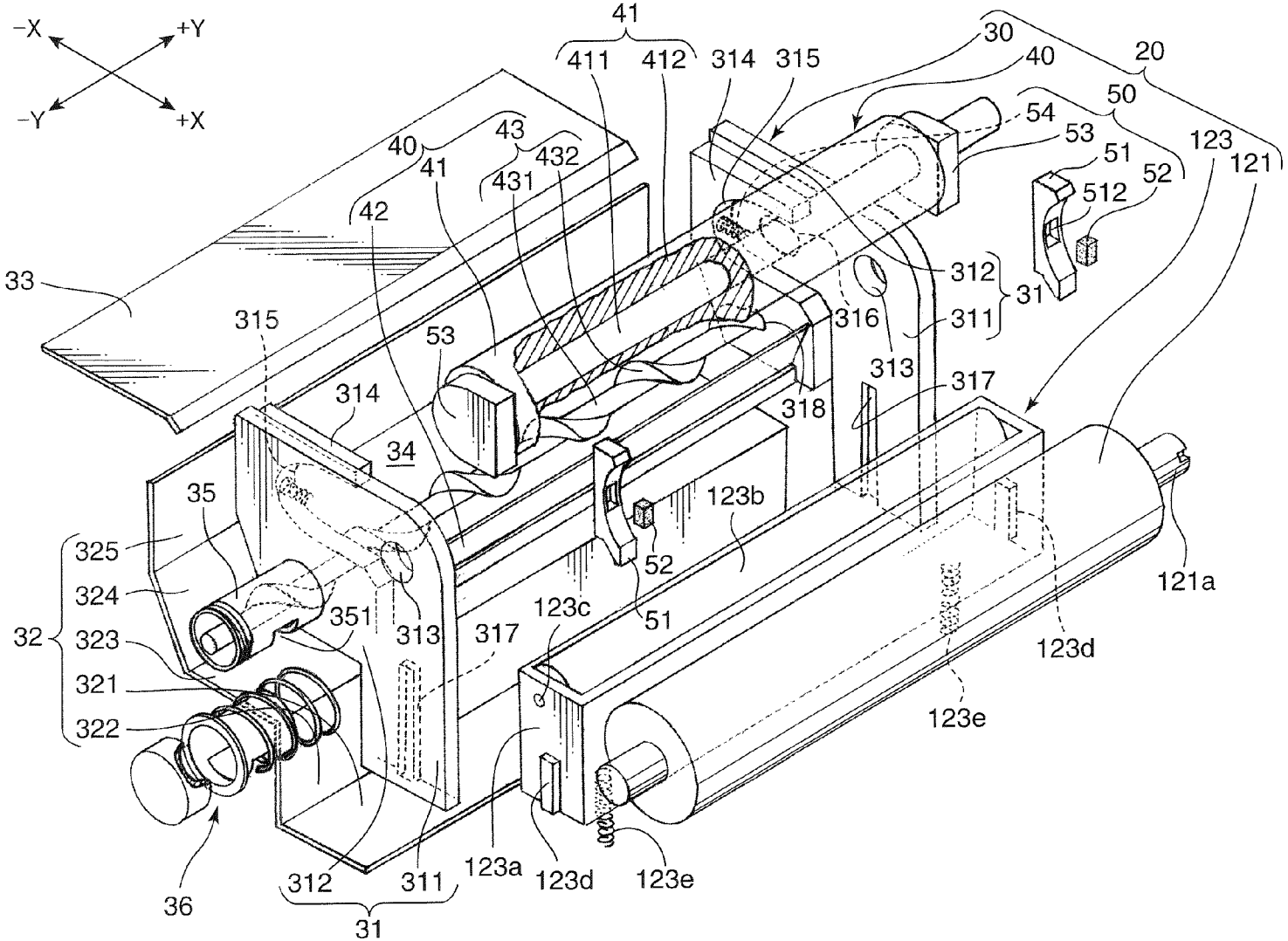
FIG. 3 is an exploded perspective view, partly cut away, showing one embodiment of a drum unit.
Figure 4:
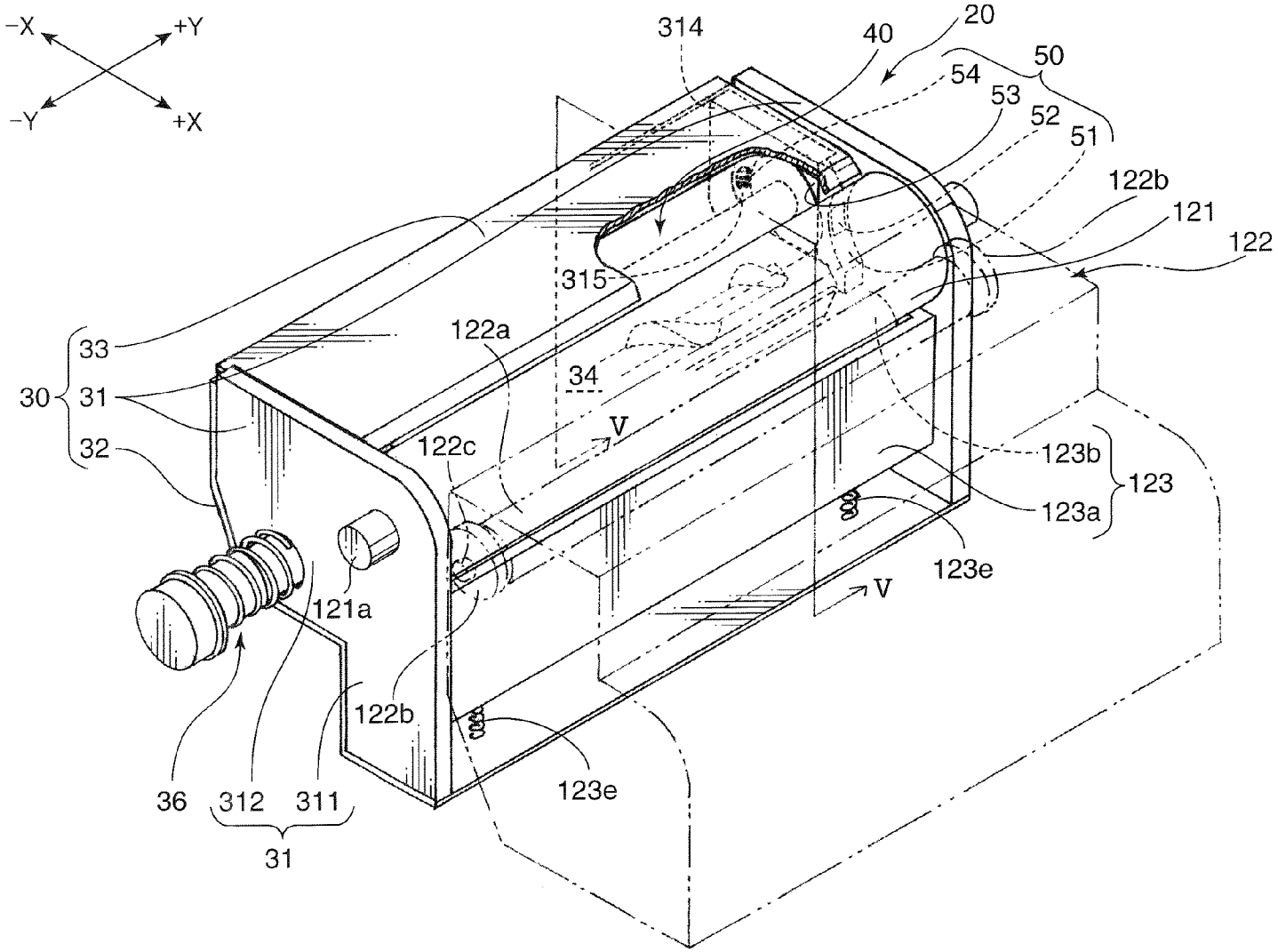
FIG. 4 is an assembled perspective view of the drum unit of FIG. 3.
Figure 5:
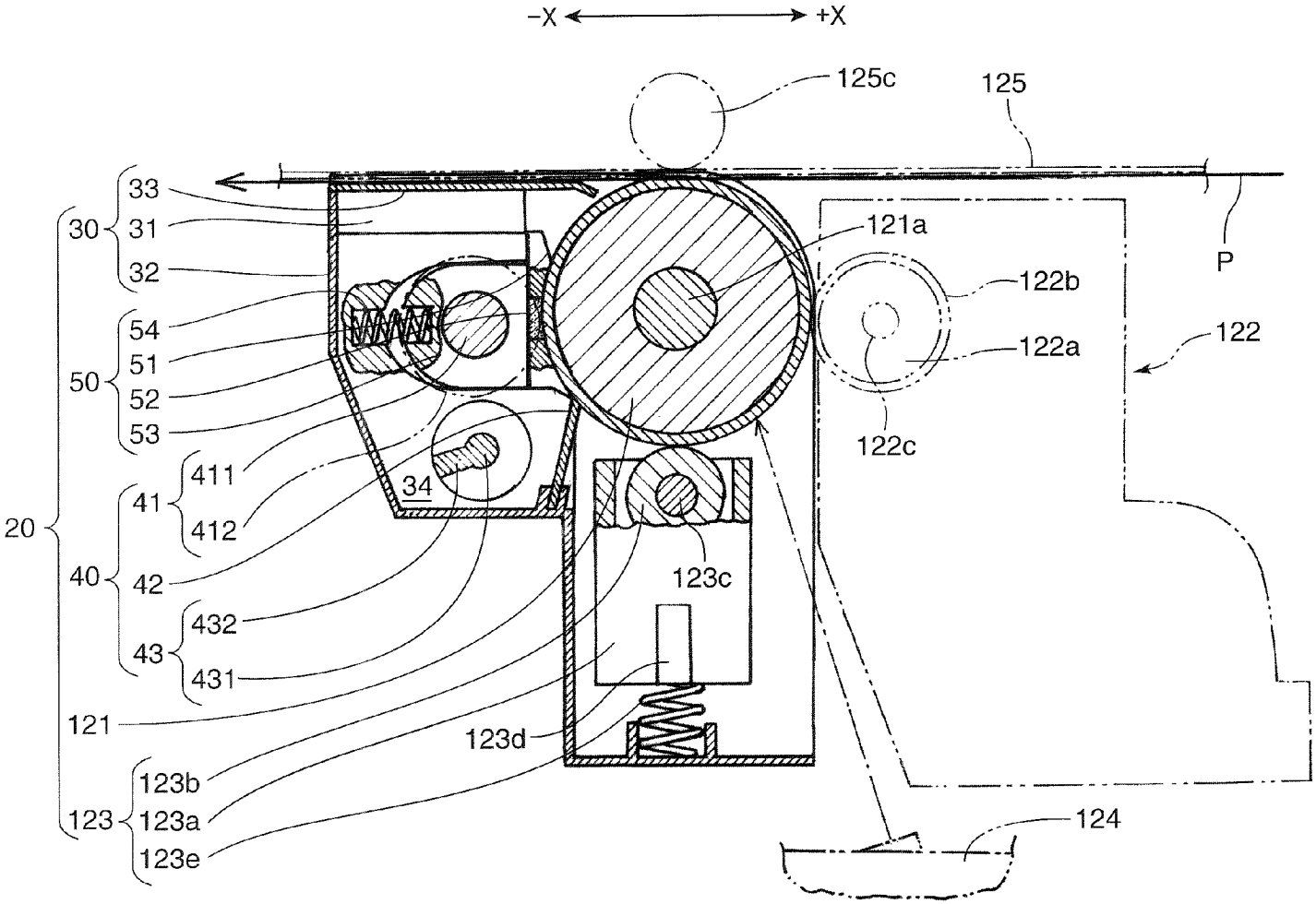

FIG. 3 is an exploded perspective view, partly cut away, showing the drum unit 20. FIG. 4 is an assembled perspective view of the drum unit 20. FIG. 5 is a section along V-V of FIG. 4. In FIGS. 3 to 5, direction indication by X and Y is the same as in the case of FIG. 1 (−X: leftward, +X: rightward, −Y: forward, +Y: backward).

The drum unit 20 includes a housing 30, the photoconductive drum 121, the charger 123, the drum cleaner 40 and the lubricant applicator 50 which are all housed in this housing 30. The housing 30 includes a pair of front and rear side plates 31 having an inverted L-shaped front view when viewed in −Y direction, a connecting plate 32 connecting the left sides of this pair of side plates 31 and a ceiling plate 33 connecting the upper sides of the pair of side plates 31.

Each side plate 31 includes a vertically extending plate 311 and a horizontally extending plate 312 extending to the left from a substantially upper half of the vertically extending plate 311. A drum shaft fitting hole 313 is perforated at a right-upper position of each side plate 31, into which a drum shaft 121*a* of the photoconductive drum 121 is fittable.

On facing surfaces of the horizontally extending plates 312 of the respective side plates 31, thickened portions 314 are formed to bulge out in facing directions to have a specified thickness. Each thickened portion 314 is formed with a mounting recess 315 by making a leftward extending cut in the right end surface. Movable brackets 53 to be described later are so fitted into these mounting recesses 315 as to be laterally movable.

A laterally long oblong hole 316 is perforated at a position of the horizontally extending plate 312 of the rear side plate 31 corresponding to the mounting recess 315. A roller shaft 411 to be described later is so fitted into this oblong hole 316 as to be slightly laterally movable.

Vertically extending mounting grooves 317 are formed in substantially lower halves of facing surfaces of the vertically extending plates 311 of the pair of side plates 31. A pair of front and rear ribs 123*d* of the charger 123 to be described later are fitted into these mounting grooves 317.

The charger 123 includes a casing 123*a* and a charging roller 123*b* housed in this casing 123*a* such that an upper part thereof slightly project. The casing 123*a* is in the form of a rectangular parallelepiped having an open upper surface and a length slightly shorter than an inner dimension between the respective vertically extending plates 311 of the pair of side plates 31. The charging roller 123*b* is supported rotatably about a roller shaft 123*c* extending between the front and rear side plates of the casing 123*a*. A voltage is applied from an unillustrated power supply device to the charging roller 123*b*, whereby the circumferential surface of the photoconductive drum 121 held in contact with the circumferential surface of the charging roller 123*b* is charged.

The ribs 123*d* fittable into the respective mounting grooves 317 formed in the facing surfaces of the respective vertically extending plates 311 of the housing 30 while being held in sliding contact therewith are provided on the front and rear side plate of the casing 123*a*. Accordingly, by fitting the respective ribs 123*d* into the corresponding mounting grooves 317, the charger 123 can be vertically moved while the ribs 123*d* are guided by the mounting grooves 317.

A specified number of coil springs 123*e* are provided in a compressed state between a bottom plate 321 of the housing 30 and a bottom plate of the casing 123*a* of the charger 123*b*. The circumferential surface of the charging roller 123 is pressed into contact with that of the photoconductive drum 121 by biasing forces of the coil springs 123*e* with the charger 123 mounted between the front and rear side plates 31.

The connecting plate 32 connects the pair of side plates 31 with each other and closes openings at the left and lower sides between the pair of side plates 31. The connecting plate 32 is formed to have such a step shape as to extend along the left and bottom edges of the side plates 31 in a front view viewed in −Y direction.

Specifically, the connecting plate 32 is made up of the bottom plate 321 corresponding to the bottom edges of the vertically extending plates 311 of the side plates 31, a lower left plate 322 standing up from the left edge of the bottom plate 321 and corresponding to a part of the vertically extending plates 311 below the horizontally extending plates 312, a middle bottom plate 323 extending leftward from the upper edge of the lower left plate 322 along the bottom edges of the horizontally extending plates 312 of the side plates 31, an inclined plate 324 extending from the left edge of the middle bottom plate 323 along oblique parts of the horizontally extending plates 312 of the side plates 31 at the left side, and an upper left plate 325 extending upward from the upper edge of the inclined plate 324.

The housing 30 as shown in FIG. 4 is formed by fixing the connecting plate 32 with the left surfaces of the pair of side plates 31, for example, using unillustrated screws and fixing the ceiling plate 33 to the upper edges of the respective thickened portions 314 of the horizontally extending plates 312 of the pair of side plates 31, for example, using screws.

The drum cleaner 40 cleans the circumferential surface of the photoconductive drum 121 by removing extraneous matters from this circumferential surface. The extraneous matters include residual toner remaining on the circumferential surface of the photoconductive drum 121 after the transferring process to the sheet P and nitrogen oxides generated and deposited on the circumferential surface of the photoconductive drum 121 during high voltage application to this circumferential surface by the charger 123.

The drum cleaner 40 includes a cleaning roller 41 extending between the respective thickened portions 314 of the pair of side plates 31, a blade 42 disposed at a position right below the cleaning roller 41, and a toner conveyance screw 43 arranged between the blade 42 and the inclined plate 324 of the connecting plate 32 at a position right above the middle bottom plate 32.

The cleaning roller 41 is rotated in a forward direction at a higher speed than the photoconductive drum 121 while the circumferential surface thereof is held in sliding contact with that of the photoconductive drum 121, thereby removing extraneous matters deposited on the circumferential surface of the photoconductive drum 121. The cleaning roller 41 includes the roller shaft 411 and a roller body 412 concentrically and integrally rotatably fitted on the roller shaft 411. The roller shaft 411 is mounted in the housing 30 such that the front end of the roller shaft 411 is supported on the front movable bracket 53 mounted in the front mounting recess 315 and the rear end of the roller shaft 411 penetrates through the rear movable bracket 53 mounted in the rear mounting recess 315 and passes through the oblong hole 316.

The pair of front and rear movable brackets 53 respectively fitted in the front and rear mounting recesses 315 are biased rightward by coil springs (biasing members) 54 to be described later, whereby the circumferential surface of the roller body 412 of the cleaning roller 41 is pressed into contact with that of the photoconductive drum 121. By this press contact, extraneous matters on the circumferential surface of the photoconductive drum 121 are effectively removed. The extraneous matters removed from the circumferential surface of the photoconductive drum 121 are collected into an extraneous matter collecting space 34 enclosed by the horizontally extending plates 312 of the pair of side plates 31, the middle bottom plate 323, the inclined plate 324 and the blade 42.

The blade 42 is disposed at the position right below the cleaning roller 41 to scrape off the extraneous matters on the circumferential surface of the photoconductive drum 121 that could not be removed by the drum cleaner 40. The blade 42 is long in forward and backward directions (specifically has the same length as an inner dimension between the front and rear thickened portions 314) and inclined upward toward the right so that the leading end thereof reaches the circumferential surface of the photoconductive drum 121 as shown in FIG. 5 with the base end thereof fixed to the right end of the middle bottom plate 323 of the connecting plate 32.

The photoconductive drum 121 is rotated about the drum shaft 121*a* in a counterclockwise direction in FIG. 5, whereby extraneous matters such as residual toner and nitrogen oxides adhering to the circumferential surface of the photoconductive drum 121 are scraped off by the leading end (upper end) of the blade 42. In this way, an image formation region of the photoconductive drum 121 is cleaned. The extraneous matters scraped off from the circumferential surface of the photoconductive drum 121 are collected into the extraneous matter collecting space 34.

The toner conveyance screw 43 discharges collected matters such as residual toner collected into the extraneous matter collecting space 34 to the outside. The toner conveyance screw 43 includes a screw shaft 431 extending between and penetrating through the respective thickened portions 314 of the pair of side plates 31, and a spiral screw fin 432 concentrically and integrally rotatably fitted on the screw shaft 431 to carry the collected matters out by the rotation about the screw shaft 431.

An insertion hole 318, into which the rear end of the roller shaft 411 is inserted, is perforated in the thickened portion 314 of the rear side plate 31, and a discharging tube body 35 for discharging the collected matters to an outer side (front side) is provided on the thickened portion 314 of the front side plate 31. The front end of the toner conveyance screw 43 is inserted into this discharging tube body 35 and a discharge port 351 is formed at a specified position at the lower side of the discharging tube body 35.

A specified shutter member 36 formed by combining a shutter mechanism, a spring and the like is mounted on the discharging tube body 35. By mounting the drum unit 20 into the apparatus body 11, the shutter member 36 interferes with a specified member in the apparatus body 11 to open the discharge port 351. On the other hand, by pulling the drum unit 20 out from the apparatus body 11, the interference between the specified member in the apparatus body 11 and the shutter member 36 is canceled to close the discharge port 351.

The photoconductive drum 121, the cleaning roller 41 and the toner conveyance screw 43 are linked with each other via unillustrated gears disposed between the drum shaft 121*a*, the roller shaft 411 and the screw shaft 431. When a driving force of an unillustrated drive motor is, for example, transmitted to the drum shaft 121*a* to rotate the photoconductive drum 121 in the counterclockwise direction of FIG. 5, this rotation is translated into a clockwise rotation of the cleaning roller 41 whose circumferential speed is set to be faster than that of the photoconductive drum 121 and a rotation of the toner conveyance screw 43 in a specified direction.

The developing device 122 shown by chain double-dashed line in FIGS. 4 and 5 includes a developing roller 122*a* for supplying the toner to the photoconductive drum 121 and gap rollers 122*b* arranged at the opposite ends of the developing roller 122*a*. The gap rollers 122*b* are provided to define a specified gap between the circumferential surface of the developing roller 122*a* and that of the photoconductive drum 121. The gap rollers 122*b* and the developing roller 122*a* concentrically rotate. In other words, the developing roller 122*a* includes a rotary shaft 122*c* and the gap rollers 122*b* are mounted at the opposite end positions of this rotary shaft 122*c*.

The lubricant applicator 50 is for applying the lubricant to the circumferential surfaces of the opposite end portions of the photoconductive drum 121 lying outside the image formation region. The lubricant is applied to the circumferential surfaces of the opposite end portions of the photoconductive drum 121 for the following reason. Specifically, the circumferential surfaces of the opposite end portions of the photoconductive drum 121 lie outside the image formation region and, accordingly, residual toner is unlikely to adhere thereto. Thus, these circumferential surfaces are not cleaned by the drum cleaner 40.

However, the gap rollers 122*b* are held in contact with the opposite end portions of the photoconductive drum 121 as shown in FIGS. 4 and 5. Accordingly, if foreign matters such as residual toner and nitrogen oxides scattered to the opposite end portions of the photoconductive drum 121 adhere to and deposit on the opposite end portions of the photoconductive drum 121, the gap rollers 122*b* run onto and, then, run off from the extraneous matters as the photoconductive drum 121 is rotated. This behavior causes the developing device 122 to swing.

If the developing device 122 swings, a strictly dimensioned gap size between the circumferential surface of the photoconductive drum 121 and that of the developing roller 122*a* changes. If the gap size changes, the toner cannot be supplied from the circumferential surface of the developing roller 122*a* toward that of the photoconductive drum 121 in a stable state, with the result that no proper toner image is formed on the circumferential surface of the photoconductive drum 121, i.e. an image failure occurs. The lubricant applicator 50 applies the lubricant to the circumferential surfaces of the opposite end portions of the photoconductive drum 121 in order to eliminate such an image failure. This reduces the frictional resistance of these circumferential surfaces to make them highly lubricant, thereby preventing the adhesion of foreign matters.

As shown in FIG. 3, the lubricant applicator 50 includes side sealing members 51 held in contact with the circumferential surfaces of the opposite end portions of the photoconductive drum 121, lubricants 52 held in the side sealing member 51, the movable blocks 53 having the side sealing members 51 bonded to the right end surfaces thereof and functioning as bearings for the roller shaft 411, and the coil springs 54 for biasing the movable brackets 53 toward the photoconductive drum 121.

Although the side sealing members 51 are members for supporting the lubricants 52 in this embodiment, they are originally used to prevent the toner from leaking from the circumferential surface of the photoconductive drum 121.

Figure 6A:
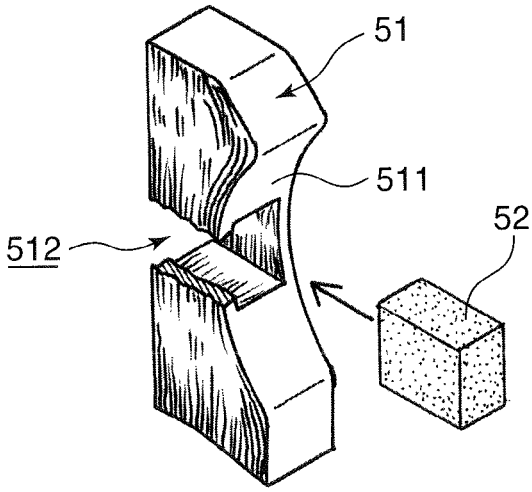
FIG. 6A shows a state before a lubricant is mounted in the side sealing member and FIG. 6B shows a state where the lubricant is mounted in the side sealing member.
Figure 6A:
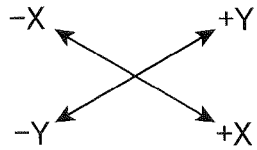
Figure 6B:
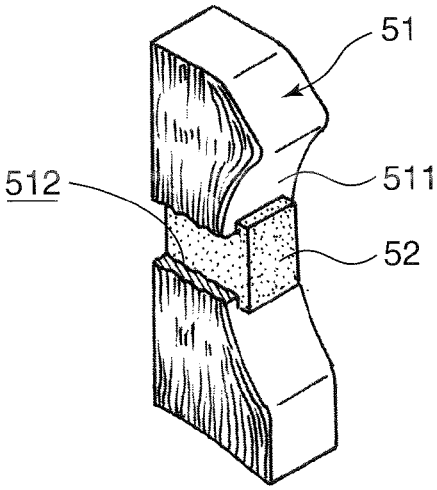

FIGS. 6A and 6B are perspective views, partly cut away, showing one embodiment of the side sealing member 51, wherein FIG. 6A shows a state immediately before the lubricant 52 is mounted into the side sealing member 51 and FIG. 6B shows a state where the lubricant 52 is mounted in the side sealing member 51. Direction indication by X and Y in FIGS. 6A and 6B is the same as in the case of FIG. 1 (−X: leftward, +X: rightward, −Y: forward, +Y: backward).

As shown in FIG. 6A, the side sealing member 51 is formed by cutting a plurality of acrylic pile sealing materials (sheet-like sealing members made of an acrylic resin) laterally laminated using a specified adhesive while pressing them by a specified mold. An arcuate edge surface 511 to be held in sliding surface contact with the circumferential surface of the photoconductive drum 121 is formed in the right end surface of such a side sealing member 51. A mount hole 512, into which the lubricant 52 is fitted, is perforated in a central part of this arcuate edge surface 511.

The lubricants 52 are abraded against the circumferential surfaces of the opposite end portions of the photoconductive drum 121 while being fitted in the mount holes 512 of the side sealing members 51 and lubricants solid at ordinary temperature are used. The lubricants 52 are shaped identical to the inner shape of the mount holes 512, thereby being closely fitted into the mount holes 512. Since the mount hole 512 is rectangular parallelepipedic in an example shown in FIG. 6A, the lubricant 52 is set to have a rectangular parallelepipedic shape in conformity.

Metal salts of fatty acids such as palmitic acids, stearic acids or oleic acids are preferably used as such lubricants 52. Since metal salts of such fatty acids are solid at ordinary temperature like solid soap and have slimy surfaces, they are suitable materials to be abraded to apply a lubricant component to the circumferential surface of the photoconductive drum 121. As shown in FIG. 6B, the lubricant 52 is so fitted in the mount hole 512 of the side sealing member 51 as to partly project from the arcuate edge surface 511. This projecting part of the lubricant 52 is held in contact with the circumferential surface of the photoconductive drum 121.

The respective movable brackets 53 are so fitted into the mounting recesses 315 formed in the thickened portions 314 of the respective side plates 31 as to be laterally movable while being held in sliding contact. The coil spring 54 is disposed between the left end surface of the movable bracket 53 and the left end surface of the mounting recess 315. This coil spring 54 presses the movable bracket 53 rightward by its biasing force (see FIG. 5).

The biasing forces of the coil springs 54 press the circumferential surface of the roller main body 412 into contact with the circumferential surface of the image formation region of the photoconductive drum 121 via the roller shaft 411 supported on the movable brackets 53. Further, these biasing forces press the side sealing members 51 into contact with the respective circumferential surfaces of the opposite end portions of the photoconductive drum 121 via the movable brackets 53. In this way, the lubricants 52 held in the respective side sealing members 51 are pressed into contact with the circumferential surfaces of the opposite end portions of the photoconductive drum 121. Accordingly, when the photoconductive drum 121 is rotated about the drum shaft 121*a*, the lubricants 52 are abraded against the end portions of the photoconductive drum 121 to apply the lubricant component to these circumferential surfaces of the opposite end portions.

As described in detail above, the image forming apparatus 10 according to this embodiment includes the drum unit 20 for each toner color constructed by unitizing the photoconductive drum 121, the charger 123, the drum cleaner 40 and the lubricant applicator 50. The lubricant applicator 50 applies the lubricants 52 to the opposite end portions of the photoconductive drum 121.

According to such an image forming apparatus 10, the lubricants 52 from the lubricant applicator 50 are applied to the opposite end portions of the photoconductive drum 121 to reduce the frictional resistance of the circumferential surfaces of the opposite end portions. This not only suppresses the adhesion of foreign matters such as residual toner and nitrogen oxides to these parts, but also makes foreign matters easily peelable even if they adhere. Thus, it can be suppressed that foreign matters are squeezed between the gap rollers 122*b* and the photoconductive drum 121. Therefore, the problem that the gap size between the photoconductive drum 121 and the developing roller 122*a* changes to make the toner supply from the developing device 122 to the photoconductive drum 121 unstable can be prevented from occurring, with the result that the occurrence of an image failure can be prevented.

Since the lubricants 52 used are solid at ordinary temperature, they can be easily handled and the lubricant component can be easily applied according to the rotation of the photoconductive drum 121 simply by holding the solid lubricants 52 in contact with the circumferential surface of the photoconductive drum 121. This contributes to the simplified structure of the lubricant applicator 50.

Further, since the lubricants 52 are pressed against the circumferential surfaces of the opposite end portions of the photoconductive drum 121 by the biasing forces of the coil springs 54, the lubricant component is applied to the circumferential surface of the photoconductive drum 121 as the photoconductive drum 121 is rotated. Accordingly, the lubricants 52 can be reliably applied to the photoconductive drum 121 with the lubricant applicator 50 fairly simplified in its structure.

The present invention is not limited to the above embodiment and can also contain the following contents.

(1) Although the copier is taken as an example of the image forming apparatus 10 employing the lubricant applicator 50 in the above embodiment, the image forming apparatus 10 may be a printer or a facsimile machine without being limited to the copier.

(2) Although the side sealing members 51 are made of the acrylic pile sealing materials in the above embodiment, non-woven fabrics, sponges, felt materials, foamable synthetic resins or the like may be used instead of the acrylic pile sealing materials.

(3) In the above embodiment, the lubricants 52 are embedded into the mount holes 512 of the side sealing members 51.

Instead, the lubricants 52 may be arranged on upstream ends of the side sealing members 51 in the rotating direction of the photoconductive drum 121, i.e. on the upper edge surfaces of the side sealing members 51, for example, by bonding.

(4) Although the side sealing members 51 are mounted on the movable brackets 53 in the above embodiment, they may be mounted on the opposite ends of the blade 42 or at specified positions of the housing 30 instead.

(5) Although the charging roller 123*b* is used as the charger 123 in the above embodiment, the circumferential surface of the photoconductive drum 121 may be charged by corona discharge from a charging wire instead.

(6) Although the photoconductive drum 121 is taken as an example of the image bearing member in the above embodiment, the image bearing member may be an endless belt without being limited to the photoconductive drum 121.

The above specific embodiment mainly embraces inventions having the following constructions.

An image forming apparatus according to one aspect of the present invention includes an image bearing member for bearing a toner image while rotating; a developing device including a developing roller for supplying toner to a surface of the image bearing member and a pair of gap rollers held in contact with opposite end portions of the image bearing member to define a specified gap between the developing roller and the surface of the image bearing member; and a lubricant applicator for applying a lubricant to parts of the opposite end portions of the image bearing member where the gap rollers are in contact.

Here, if the image bearing member is a transfer belt mounted between a pair of rollers, the rotation of the image bearing member is literally a rotation of the transfer belt between the pair of rollers. If the image bearing member is a photoconductive drum, it means a rotation of the photoconductive drum about a drum axis.

According to the above construction, frictional resistance of surfaces of the opposite end portions can be reduced since the lubricant from the lubricant applicator is applied to the opposite end portions of the image bearing member. This not only suppresses the adhesion of foreign matters such as residual toner and nitrogen oxides to these parts, but also makes foreign matters easily peelable even if they adhere. In this way, the presence of foreign matters between the gap rollers held in contact with the opposite end portions and the image bearing member is prevented. Thus, a problem that the toner supply from the developing roller to the image bearing member becomes unstable due to a change of a gap size, thereby causing an image failure, can be prevented from occurring and a stable and proper image forming process can be constantly ensured.

In the above construction, the pair of gap rollers may be so mounted on the opposite ends of the developing roller as to be coaxial with the developing roller. According to this construction, the specified gap can be stably ensured.

In the above construction, the lubricant is preferably solid at ordinary temperature. According to this construction, the lubricant solid at ordinary temperature is easily handled and is easily applied according to the rotation of the image bearing member simply by holding the solid lubricant in contact with the surface of the image bearing member, wherefore the structure of the lubricant applicator can be simplified.

In the above construction, the lubricant applicator preferably includes a pair of side sealing members for sealing toner leakage by being respectively held in sliding contact with the surfaces of the opposite end portions of the image bearing member and retaining lubricants while holding lubricants in contact with the surfaces of the opposite end portions of the image bearing member. According to this construction, the lubricants can be retained utilizing the sealing members for sealing the toner leakage and it is not necessary to separately provide a retaining member.

In this case, it is preferable that the image bearing member is a photoconductive drum; and that each sealing member includes an arcuate edge surface extending along the outer circumferential surface of the photoconductive drum and a mount hole which is perforated in the arcuate edge surface and into which the lubricant is to be fitted. According to this construction, since the lubricants are arranged on the arcuate edge surfaces extending along the outer circumferential surface of the photoconductive drum, they can be stably applied to the opposite end portions of the photoconductive drum.

The lubricant applicator preferably further includes biasing members for biasing the pair of sealing members toward the image bearing member. According to this construction, the lubricant is applied to the surface of the image bearing member as the image bearing member is rotated since the respective lubricants retained by the sealing members are pressed against the surfaces of the opposite end portions of the image bearing member by biasing forces of the biasing members. Thus, the lubricants can be reliably applied to the image bearing member with the lubricant applicator fairly simplified in its structure.

An image forming unit according to another aspect of the present invention includes a housing, a photoconductive drum rotatably mounted in the housing, adapted to bear a toner image and including parts at opposite end portions thereof where gap rollers are to be held in contact; and a lubricant applicator for applying a lubricant to parts of the photoconductive drum where the gap rollers are held in contact.

According to this construction, frictional resistance of surfaces of the opposite end portions can be reduced since the lubricant from the lubricant applicator is applied to the opposite end portions of the photoconductive drum. This can prevent the presence of foreign matters between the gap rollers held in contact with the opposite end portions of the photoconductive drum and a surface of the drum.

In this case, if the lubricant used is solid at ordinary temperature, it is easy to handle the lubricant and sufficient only to hold this sold lubricant in contact with the surface of the photoconductive drum and the structure of the lubricant applicator can be simplified.

In the above construction, it is preferable that a cleaning roller to be held in contact with the circumferential surface of the photoconductive drum and a pair of brackets mounted in the housing for rotatably supporting the opposite ends of the cleaning roller are further provided; that the lubricant applicator includes retaining members to be mounted on the brackets; and that the retaining members retain lubricants while holding them in contact with the surfaces of the opposite end portions of the photoconductive drum. According to this construction, the lubricants can be supported via the retaining members, utilizing the brackets for supporting the cleaning roller.

In this case, the retaining members are preferably sealing members for sealing toner leakage by being respectively held in sliding contact with the surfaces of the opposite end portions of the photoconductive drum. According to this construction, the lubricants can be retained utilizing the sealing members for sealing the toner leakage and it is not necessary to separately provide the retaining members.

In the above construction, it is preferable that the brackets are movable brackets movable in a direction toward the photoconductive drum, and that biasing members are further provided to bias the movable brackets toward the photoconductive drum. According to this construction, the lubricants can be reliably applied to the photoconductive drum since being pressed against the surfaces of the opposite end portions of the photoconductive drum by the biasing members.

As described above, according to the present invention, the presence of foreign matters between the circumferential surface of the image bearing member and the gap rollers can be suppressed. Therefore, the toner can be stably supplied from the developing device to the image bearing member without changing the gap size between the image bearing member and the developing roller and, consequently, the occurrence of an image failure can be prevented.

This application is based on Japanese Patent application serial No. 2008-218229 filed in Japan Patent Office on Aug. 27, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

a photoconductive drum for bearing a toner image while rotating;

a developing device including a developing roller for supplying toner to a surface of the photoconductive drum and a pair of gap rollers held in contact with opposite end portions of the photoconductive drum to define a specified gap between the developing roller and the surface of the photoconductive drum; and a lubricant applicator for applying a lubricant to parts of the opposite end portions of the photoconductive drum where the gap rollers are in contact, the lubricant being solid at ordinary temperature, the lubricant applicator including a pair of side sealing members for sealing toner leakage by being respectively held in sliding contact with the surfaces of the opposite end portions of the photoconductive drum, and each of the side sealing members retaining the lubricant while holding the lubricant in contact with each of the surfaces of the opposite end portions of the photoconductive drum, each sealing member including an arcuate edge surface extending along the outer circumferential surface of the photoconductive drum and a mount hole perforated in the arcuate edge surface and into which the lubricant is to be fit.

2. An image forming apparatus according to claim 1, wherein the pair of gap rollers are so mounted on the opposite ends of the developing roller as to be coaxial with the developing roller.

3. An image forming apparatus according to claim 1, wherein the lubricant applicator further includes biasing members for biasing the pair of sealing members toward the photoconductive drum.

4. An image forming unit, comprising:

a housing;

a photoconductive drum rotatably mounted in the housing, adapted to bear a toner image and including parts at opposite end portions thereof where gap rollers are to be held in contact;

a cleaning roller to be held in contact with the circumferential surface of the photoconductive drum;

a pair of brackets mounted in the housing for rotatably supporting the opposite ends of the cleaning roller; and a lubricant applicator for applying a lubricant to parts of the photoconductive drum where the gap rollers are to be held in contact, the lubricant being solid at ordinary temperature, the lubricant applicator including retaining members to be mounted on the brackets, and each of the retaining members retaining the lubricant while holding the lubricant in contact with each of the surfaces of the opposite end portions of the photoconductive drum.

5. An image forming unit according to claim 4, wherein the retaining members are sealing members for sealing toner leakage by being respectively held in sliding contact with the surfaces of the opposite end portions of the photoconductive drum.

6. An image forming unit according to claim 4, wherein:

the brackets are movable brackets movable in a direction toward the photoconductive drum; and the image forming unit further comprises biasing members for biasing the movable brackets toward the photoconductive drum.

7. An image forming apparatus, comprising:

an image bearing member for bearing a toner image while rotating;

a developing device including a developing roller for supplying toner to a surface of the image bearing member and a pair of gap rollers held in contact with opposite end portions of the image bearing member to define a specified gap between the developing roller and the surface of the image bearing member; and a lubricant applicator for applying a lubricant to parts of the opposite end portions of the image bearing member where the gap rollers are in contact, the lubricant being solid at ordinary temperature, the lubricant applicator including a pair of side sealing members for sealing toner leakage by being respectively held in sliding contact with the surfaces of the opposite end portions of the image bearing member, the lubricant applicator further including biasing members for biasing the pair of sealing members toward the image bearing member, the side sealing members retaining the lubricant while holding the lubricant in contact with each of the surfaces of the opposite end portions of the image bearing member.

8. An image forming apparatus according to claim 7, wherein the pair of gap rollers are so mounted on the opposite ends of the developing roller as to be coaxial with the developing roller.

9. An image forming apparatus according to claim 7, wherein:

the image bearing member is a photoconductive drum; and each sealing member includes an arcuate edge surface extending along the outer circumferential surface of the photoconductive drum and a mount hole which is perforated in the arcuate edge surface and into which the lubricant is to be fit.

* * * * *